United States Patent [19]

Calisto

[11] 4,382,530

[45] May 10, 1983

[54] INTERCHANGEABLE NOZZLE APPARATUS

[76] Inventor: Anthony Calisto, 7502 Central Ave., Takoma Park, Md. 20012

[21] Appl. No.: 279,385

[22] Filed: Jul. 1, 1981

[51] Int. Cl.[3] ..... B65D 25/48

[52] U.S. Cl. ..... 222/567; 222/326

[58] Field of Search ..... 222/325, 326, 327, 566, 222/567, 568; 285/404

[56] References Cited

U.S. PATENT DOCUMENTS

| | | | |
|---|---|---|---|
| 2,953,285 | 9/1960 | McKelvey | 222/567 |
| 3,439,839 | 4/1969 | Schumann et al. | 222/95 |
| 3,756,516 | 9/1973 | Trnka | 239/539 |
| 4,253,685 | 3/1981 | Camp | 285/41 |

*Primary Examiner*—Joseph J. Rolla
*Assistant Examiner*—Michael S. Huppert
*Attorney, Agent, or Firm*—Sughrue, Mion, Zinn, Macpeak and Seas

[57] ABSTRACT

An interchangeable nozzle apparatus for a caulking gun includes a base member which is fittable over the tapered nozzle on a caulking tube and has a universal mounting surface thereon, a plurality of nozzle attachments of different diameters each having a similar mounting portion which mates with the universal base mounting portion, and a securing member such as a thumbscrew for affixing any one of the attachment nozzles to the base member.

6 Claims, 2 Drawing Figures

FIG. 1
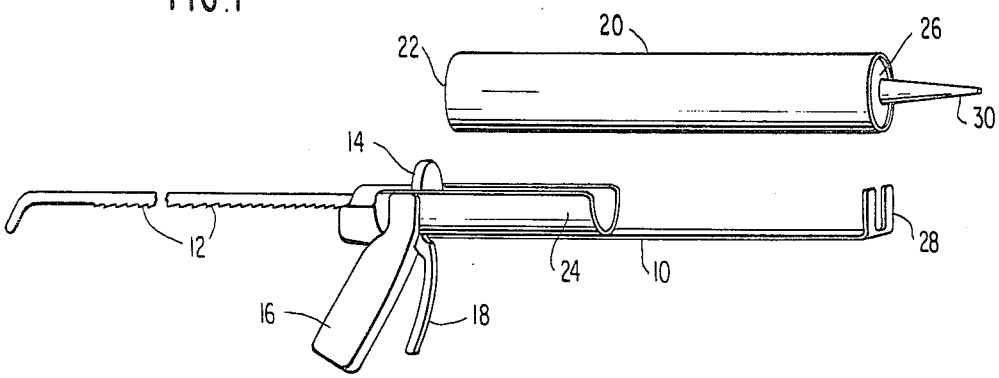
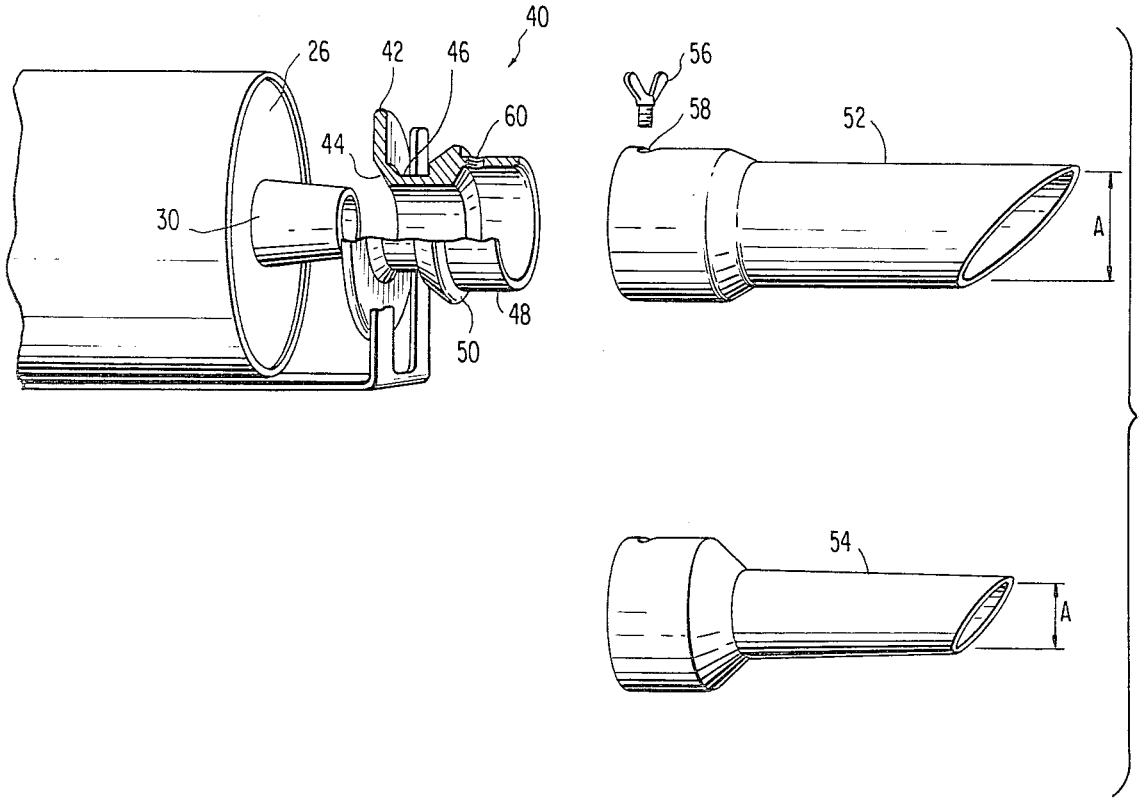
FIG. 2

INTERCHANGEABLE NOZZLE APPARATUS

BACKGROUND OF THE INVENTION

This invention relates to nozzled devices for applying viscous materials such as caulking or glue.

Caulking guns are well known, and may typically include, as shown in FIG. 1, a frame 10, a ratchet bar 12, a pressure plate 14 fixed to the end of the ratchet bar 12, a handle 16 and a trigger portion 18. The trigger portion 18 operates a one-way pawl device (not shown) such that squeezing the trigger 18 swill advance the pressure plate 14 to the right as shown in FIG. 1.

A container 20 of viscous caulking material, such as RTV silicone is placed in the frame portion of the gun such that the pressure plate 14 abuts the bottom 22 of the container. The container is laterally supported by curved plates 24 and is supported at its top end 26 by a bifurcated retaining member 28. The bifurcated retaining member 28 has a slot in its center into which a tapered nozzle 30 is fitted as is well known in the art. With the container 20 in place, as the trigger 18 is squeezed and the pressure plate 14 advanced, and with the bifurcated retaining member 28 preventing the forward movement of the container, the bottom 22 of the container will be moved inwardly to force the caulking material out of the nozzle 30.

The nozzle 30 provided with the container 20 is a tapered nozzle made of a flexible plastic material, with the nozzle having a maximum diameter at its base of approximately one-quarter inch. In preparing the caulking gun for operation, the user determines the desired nozzle diameter for the job to be performed, and cuts the nozzle 30 at the appropriate diameter with a scissors or the like. While this cuttable plastic nozzle provides a convenient mechanism for allowing the user to tailor the nozzle to his own particular needs, it does give rise to some difficulties. First, as mentioned above, the maximum diameter near the base of the plastic nozzle 30 is typically on the order of one-quarter inch, and it is thus difficult to effectively use the caulking gun in applications which require significantly larger nozzle diameters. Further, since the maximum diameter is near the base of the nozzle, cutting the nozzle to achieve a large diameter opening will necessarily result in a very short nozzle which is often too short to be useful. Still further, it is often the case that a single job may involve two applications of different sizes each of which requires less than the entire contents of a single container, but the nozzle diameter cannot be changed once it has been cut. Thus, for instance, it may be necessary to cut the nozzle on one container and apply half of the container contents and to then cut the nozzle on a second container and apply half of the second container's contents, after which the two half-full containers are discarded. An equally undesirable alternative would be to finish the caulking job with the same container using an improperly sized nozzle.

There have been some attempts to overcome the above-mentioned problems, but none has proven entirely satisfactory. For example, in U.S. Pat. No. 2,953,285 to McKelvey an extension nozzle apparatus is disclosed. The extension nozzle is made of a soft plastic material similar to that of the nozzle 30 in FIG. 1 of the present application, and is also tapered. The extension nozzle fits over the nozzle 30 in FIG. 1 of the present application and includes an enlarged base portion which abuts the end 26 of the caulking tube and is held in place by the bifurcated flange 28. McKelvey states that a plurality of extension nozzles of different shapes or sizes may be provided.

While McKelvey does suggest that different size extension nozzles may be provided, he points out that the extension nozzle's opening should be small so that fine or accurate caulking can be more easily accomplished, and there is no suggestion in McKelvey that the extension nozzle diameter should be larger than the maximum diameter of the tapered nozzle portion affixed to the caulking tube. Further, although extension nozzles of different sizes may be provided, it is necessary to dismantle the caulking gun in order to replace an extension nozzle. For instance, referring to FIG. 1 of the present application, the extension nozzle of McKelvey has an enlarged base portion which is secured between the bifurcated retaining member 28 and the end face 26 of the caulking tube. If the cauling tube 20 is half empty so that the pressure plate 14 is positioned near the central portion of the caulking tube, the pressure plate 14 must first be extracted from the tube 20, the tube must be removed from the caulking gun, the extension nozzle removed from the tube, a new extension nozzle placed over the tube nozzle 30, the tube reinserted into the gun, and the pressure plate reextended into the interior of the tube. After all of this, caulking can again begin with the new nozzle diameter. This is a time consuming and sometimes messy operation.

This inventor has attempted to overcome the insufficient nozzle size limitation of conventional caulking tubes by utilizing a nozzle extension similar to McKelvey except made of a copper tubing and having an enlarged diameter. While such an oversized nozzle piece is helpful, it includes a flanged base portion which fits between the bifurcated retaining member and the end face 26 of the caulking tube. Thus, as in McKelvey, it has been necessary to completely dismantle the caulking gun if a different nozzle diameter is desired.

It is therefore an object of this invention to provide a nozzle attachment for a caulking gun or the like having a nozzle diameter which is easily changed.

It is a further object of this invention to provide a nozzle apparatus having interchangeable nozzle diameters which are larger than the maximum diameter of the tapered plastic nozzle typically included as part of a caulking tube.

SUMMARY OF THE INVENTION

Briefly, these and other objects are achieved according to the present invention by an interchangeable nozzle apparatus having a base portion which fits over the plastic tapered caulking tube nozzle and has an enlarged flange which is secured between the bifurcated retaining member and the end face of the caulking tube. At the other end from the enlarged flange, the base portion is provided with a mounting surface of predetermined configuration. A plurality of attachment nozzles are provided each having different nozzle diameters at their upper, or output, ends and each having the same surface configuration at their lower ends so that all of the interchangeable nozzles will fit snugly to the mounting surface of the base portion. Also included is a mounting means, such as a thumbscrew, for securing the attachment nozzles to the base portion. In the preferred embodiment of the invention, the nozzle diameters of all of the interchangeable nozzles are greater than the maximum diameter of the tapered plastic nozzle of the caulking tube. The attachment nozzles are preferably made of a suitable soft metal such as aluminum and can be easily interchanged even during a single caulking job without the necessity of dismantling the caulking gun.

BRIEF DESCRIPTION OF THE DRAWINGS

The invention will be more clearly understood with reference to the following description in conjunction with the accompanying drawings in which:

FIG. 1 is a perspective view of a typical caulking gun in which the present invention may be used; and FIG. 2 is a perspective view, partially disassembled, of an interchangeable nozzle apparatus according to the present invention.

DETAILED DESCRIPTION OF THE INVENTION

The interchangeable nozzle apparatus according to the present invention will now be described with reference to FIG. 2. As shown in FIG. 2, the apparatus includes a base portion 40 having an enlarged flange 42 at one end. The plastic tapered nozzle 30 may be cut off at any arbitrary diameter, and the base portion 40 is placed over the cut nozzle. The base 40 preferably includes a bevelled inner surface 44 so that it will seal tightly against the plastic nozzle 30 but will not cut through the soft plastic material when pressure is exerted during operation of the caulking gun. The base portion 42 must also include a relatively small diameter neck portion 46 which has a diameter small enough so it will easily fit within the conventional slot size of the bifurcated retaining member 28. The upper portion of the base member includes a smooth mounting surface 48 and a ridge 50.

The interchangeable nozzle apparatus according to the present invention includes at least two interchangeable nozzle attachments as shown in FIG. 2, each of which snugly fits to the mounting surface 48 of the base member 40. In FIG. 2, nozzle attachment 52 may have a diameter "A" of $\frac{7}{8}$ inches, while the nozzle attachment 54 has a similar diameter of 5/16 inches. The extrusion opening is preferably cut off at a 45° angle as shown in FIG. 2. Both nozzle attachments 52 and 54 include lower ends which are of identical size and shape and fit snugly over the mounting surface 48 of the base member. Once in place, the nozzle attachment, for example attachment 52, can be secured to the base member by means of a manually operable thumbscrew 56 which passes through a mounting hole 58 to a threaded hole 60 in the base member 40. As used herein and in the appended claims, "manually operable" means that the screw may be easily used without the need of a tool.

After cutting the plastic nozzle piece 30 and placing the base member over the cut nozzle, the caulking gun is assembled in a conventional manner with the flange member 42 secured between the end face 26 of the caulking tube and the bifurcated retaining member 28. The appropriate nozzle attachment is secured to the base member and caulking is then commenced. If a different nozzle diameter is desired, it is only necessary to loosen the thumbscrew 56, replace the nozzle attachment with one of a different diameter, resecure the thumbscrew 56 and commence caulking. Thus, with the interchangeable nozzle apparatus according to the present invention, caulking nozzles can be interchanged quickly and easily without the necessity of dismantling the cualking gun. Since any caulking operations requiring a small diameter nozzle can be performed using the existing plastic nozzle 30, all of the nozzle attachments in the preferred embodiment of the invention will have extrusion diameters in excess of the maximum diameter of the nozzle 30. However, in some cases the nozzle attachments could have smaller diameters as well since this would permit small-diameter caulking operations to be performed after large-diameter operations without the necessity of disassembling the caulking gun to remove the base member 40.

The attachment nozzle pieces, e.g. 52 and 54 in FIG. 2, are preferably made of a soft metal such as aluminum. Soft plastic is a suitable material for a nozzle 30 which is to be discarded when the container is empty, but is not sufficiently durable for repeated reuse. Further, the extruding end of a nozzle attachment will often become encrusted with dried caulking material, and it is desirable to file down the end of the attachment in order to maintain a smooth extruding orifice. Accordingly, it is desirable that the metal be relatively soft.

When applying glue to large surfaces, it is typical to apply the glue to a surface using a relatively small nozzle diameter and to subsequently spread the glue with a wide straight-edge. With an interchangeable nozzle apparatus according to the present invention, it would be a simple matter to provide one of the attachment nozzles with an elongated narrow extrusion orifice or with a plurality of small spaced-apart orifices to apply and spread the glue in a single operation.

It should be appreciated that various changes and modifications could be made to the disclosed invention without departing from the spirit and scope of the invention as defined in the appended claims. For instance, while the means for connecting the base member and nozzle attachments is disclosed as a thumbscrew and threaded hole arrangement, it would be possible to thread the hole 58 in the attachment nozzle and dispense with the hole 60 in the base member so that the attachment nozzle would be secured by the friction of the thumbscrew against the mounting surface 48. Alternatively, the thumbscrew could be dispensed with entirely and some other mounting configuration used such as mating threads or other interlocking configurations provided on the mounting surface 28 and on the lower end of the attachment nozzles.

It should further be noted that although the present invention is shown as including only a pair of attachment nozzles, any number of nozzle attachments of various sizes and shapes could be provided, with a suitable kit including perhaps four nozzle attachments ranging in size from 5/16" to one inch.

What is claimed is:

1. A nozzle attachment apparatus for use with an extruding tool and a container of extrudable material, said container having an opening at one end thereof and said tool being of the type having a bifurcated retaining member for abutting said one end of said container, said bifurcating retaining member having a slot therein, said attachment apparatus comprising:

a base member fittable over said opening and having a base mounting portion at one end thereof, a flanged portion at its other end having a dimension larger than that of said slot and a central portion connecting said flanged and base mounting portions and fittable into said slot;

attachment nozzle means having an extrusion orifice at one end and fittable at its other end to said base mounting portion, said attachment nozzle means comprising a plurality of nozzles each of which is fittable to said base mounting portion and any one of which may be secured to said base member at one time, each of said attachment nozzles including an attachment mounting portion having a mating configuration with said base mounting portion; and securing means for securing said base mounting portion to the attachment mounting portion on one of said nozzle attachments.

2. A nozzle attachment apparatus as defined in claim 1, wherein said plurality of attachment nozzles have extrusion orifices of differing sizes.

3. A nozzle attachment apparatus as defined in claim 1, wherein said container opening comprises a tapered tube, and wherein the inside diameters of the extrusion orifices of each of said attachment nozzles exceed the maximum inside diameter of said tapered tube.

4. A nozzle attachment apparatus as defined in claim 1, wherein said fixing means is a manually operable screw.

5. A nozzle attachment apparatus as defined in claim 1, wherein each of said nozzle attachments is made of a relatively rigid material.

6. A nozzle attachment apparatus as defined in claim 5, wherein each of said nozzle attachments is made of a relatively soft metal such as aluminum.

* * * * *